US008148971B2

(12) United States Patent
Lu et al.

(10) Patent No.: US 8,148,971 B2
(45) Date of Patent: Apr. 3, 2012

(54) LAYOUT OF A REFERENCE GENERATING SYSTEM

(75) Inventors: Yi-Chang Lu, Taipei (TW); Cheng-Hung Li, Taipei (TW); Chung-Yui Kuo, Taipei (TW); Tsung-Yu Wu, Sinshih Township, Tainan County (TW)

(73) Assignees: Himax Technologies Limited, Tainan County (TW); National Taiwan University, Taipei (TW)

( * ) Notice: Subject to any disclaimer, the term of this patent is extended or adjusted under 35 U.S.C. 154(b) by 460 days.

(21) Appl. No.: 12/393,955

(22) Filed: Feb. 26, 2009

(65) Prior Publication Data

US 2010/0213918 A1 Aug. 26, 2010

(51) Int. Cl.
*G05F 3/16* (2006.01)

(52) U.S. Cl. ..... 323/314; 323/313

(58) Field of Classification Search ..... 323/312–315; 327/538, 539, 543
See application file for complete search history.

(56) References Cited

U.S. PATENT DOCUMENTS 6,501,299 B2 * 12/2002 Kim et al. ..... 326/83
2009/0121699 A1 * 5/2009 Park et al. ..... 323/313

* cited by examiner

*Primary Examiner* — Matthew Nguyen
(74) *Attorney, Agent, or Firm* — Stout, Uxa, Buyan & Mullins, LLP

(57) ABSTRACT

A layout of a voltage/current reference system is disclosed. A first voltage/current reference circuit (for example, a bandgap reference circuit) and a second voltage/current reference circuit are respectively laid out on either side of a substrate, such as edges or perimeter sides of the substrate. A reference voltage/current is derived by averaging respective output reference voltage/current values of the first and the second voltage/current reference circuits. Accordingly, the noise influence on the voltage/current reference system is minimized.

2 Claims, 4 Drawing Sheets

LAYOUT OF A REFERENCE GENERATING SYSTEM

BACKGROUND OF THE INVENTION

1. Field of the Invention

The present invention generally relates to voltage/current reference systems, and more particularly to a layout of a bandgap reference system.

2. Description of the Prior Art

A voltage reference system is an electronic circuit that generates a fixed voltage regardless of the loading on the circuit. A bandgap reference (BGR) circuit is a voltage reference circuit for generating a fixed reference voltage that has a value equal to the electron bandgap level of silicon (approximately 1.2 volts) and that changes very little with temperature. Bandgap reference circuits are widely used in electronic systems, such as the source driver for a liquid crystal display (LCD).

FIG. 1 shows schematically the layout of a bandgap reference circuit 10, among others, in a conventional mixed analog-digital system 1, which also includes at least one high-voltage subsystem 12 and low-voltage subsystems 14A and 14B. According to the conventional layout shown in FIG. 1, the bandgap reference circuit 10 is laid out in the middle, for example, between the low-voltage subsystems 14A and 14B, for the sake of layout symmetry.

As modern integrated circuits become more complex in design and even more enormous in size, noise becomes a non-negligible issue, which affects either the output reference voltage or current of the bandgap reference circuit 10. FIG. 2 schematically illustrates the noise influence on the bandgap reference circuit 10 in the system 1. A noise source 120 originating from the high-voltage subsystem 12 and adjacent to the bandgap reference circuit 10 affects the bandgap reference circuit 10 with noise along various courses 120A and 120B of influence (e.g., west and east courses in the figure). Subsequently, the influenced bandgap reference circuit 10 distributes the noise-added reference voltage/current to the low-voltage subsystems 14A and 14B in the directions 122A and 122B, causing the low-voltage subsystems 14A and 14B to malfunction.

For reasons including that of the conventional bandgap reference circuit not effectively defending itself against noise, a need has arisen to propose a novel bandgap reference system and layout to minimize the noise influence on the bandgap reference system and to prevent the noise from being distributed.

SUMMARY OF THE INVENTION

In view of the foregoing, it is an object of the present invention to provide a voltage/current reference system and its layout to minimize the noise influence on the voltage/current reference system.

According to one embodiment, a first voltage reference circuit (for example, a bandgap reference circuit) and a second voltage reference circuit are respectively laid out on either side of a substrate, preferably on edge sides (e.g., edges or perimeter sides) of the substrate. A first conductive power line electrically extends from a first output reference voltage of the first voltage reference circuit, and a second conductive power line electrically extends from a second output reference voltage of the second voltage reference circuit. A conductive connecting line is electrically coupled between the first conductive power line and the second conductive power line. A reference voltage node on the conductive connecting line is then used to provide a reference voltage.

Another embodiment includes a first current reference circuit (for example, a bandgap reference circuit) and a second current reference circuit respectively laid out on either side of a substrate, preferably on edges or perimeter sides of the substrate. A first current source (for example, a mirror circuit) generates a first current according to a first output reference current of the first current reference circuit, and a second current source generates a second current according to a second output reference current of the second current reference circuit. The first and the second currents are then added to provide a reference current.

DETAILED DESCRIPTION OF THE INVENTION

Figure 3:
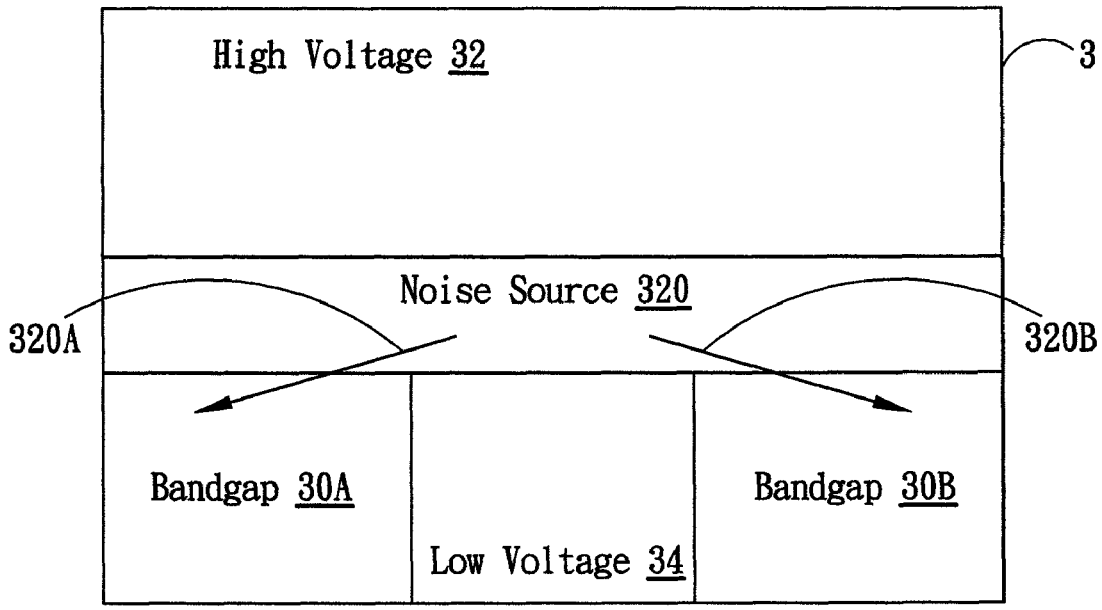
FIG. 3 illustrates a layout of bandgap reference circuits according to one embodiment of the present invention.

FIG. 3 illustrates the layout of a bandgap reference system, including a low-voltage subsystem 34 and a high-voltage subsystem 32 according to one embodiment of the present invention. A noise source 320 may exist in the high-voltage subsystem 32 or other electronic component(s) on a substrate 3. The bandgap reference system includes at least two bandgap reference circuits 30A and 30B. The first bandgap reference circuit 30A, the second bandgap reference circuit 30B, the high-voltage subsystem 32, and the low-voltage subsystem 34 together form an electronic (mixed analog-digital) system that is laid out on the substrate 3 of a chip, a printed circuit board, or a package. Although the bandgap reference circuits 30A and 30B are disclosed in the embodiment, it is appreciated that the present invention is well adapted to a voltage/current reference circuit or a reference generating system in general.

Figure 1:
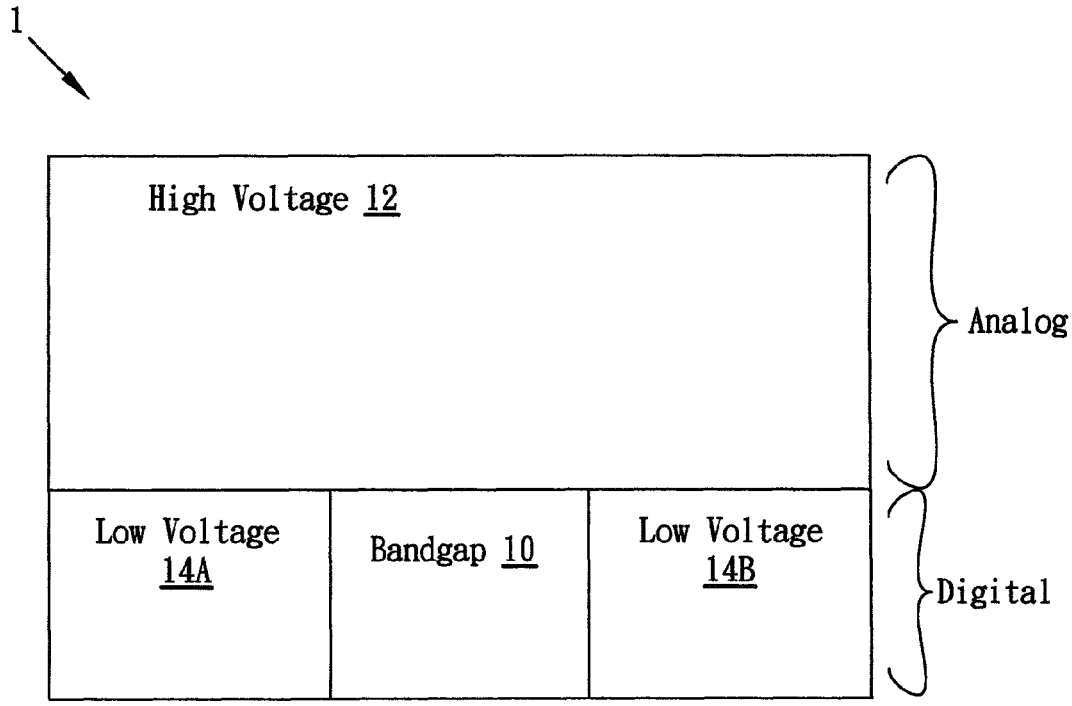
FIG. 1(Prior Art)
FIG. 1 shows schematically the layout of a conventional bandgap reference circuit.
Figure 2:
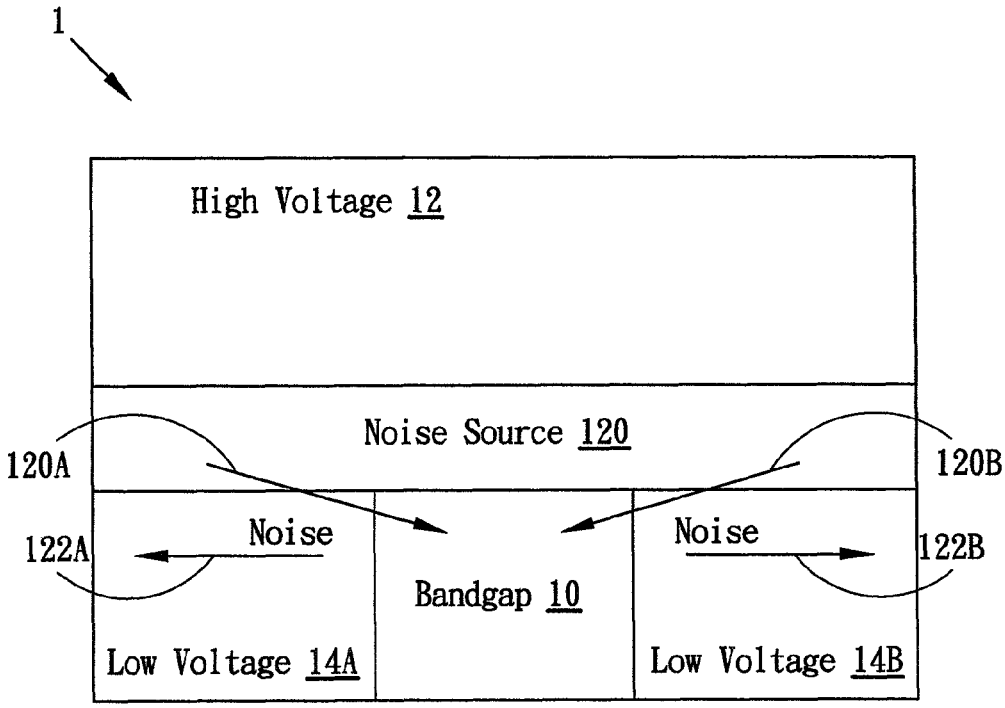
FIG. 2(Prior Art)
FIG. 2 schematically illustrates a noise influence on the conventional bandgap reference circuit.

In the depicted embodiment, the two bandgap reference circuits 30A and 30B have substantially identical architectures. The first bandgap reference circuit 30A and the second bandgap reference circuit 30B are respectively laid out on sides (e.g., either side) of the substrate 3, and preferably on edge sides (e.g., edges or perimeter sides/regions) of the substrate 3. According to the layout in FIG. 3, the noise source 320 originating from the high-voltage subsystem 32 (or other electronic component[s]) and adjacent to the bandgap reference circuits 30A and 30B affects the bandgap reference circuits 30A and 30B with noise mainly along the courses 320A and 320B of influence (e.g., west and east courses in the figure). Specifically, the first bandgap reference circuit 30A is subjected to the single course of noise influence 320A, and the second bandgap reference circuit 30B is subjected to another single course of noise influence 320B. In comparison to the layout in FIG. 2, the single bandgap reference circuit 10 in FIG. 2 is subjected to at least two courses of noise influence 120A and 120B. As a result, each of the bandgap reference circuits 30A and 30B in the embodiment advantageously is affected with less noise than the single bandgap reference circuit 10 in FIG. 2.

Figure 4:
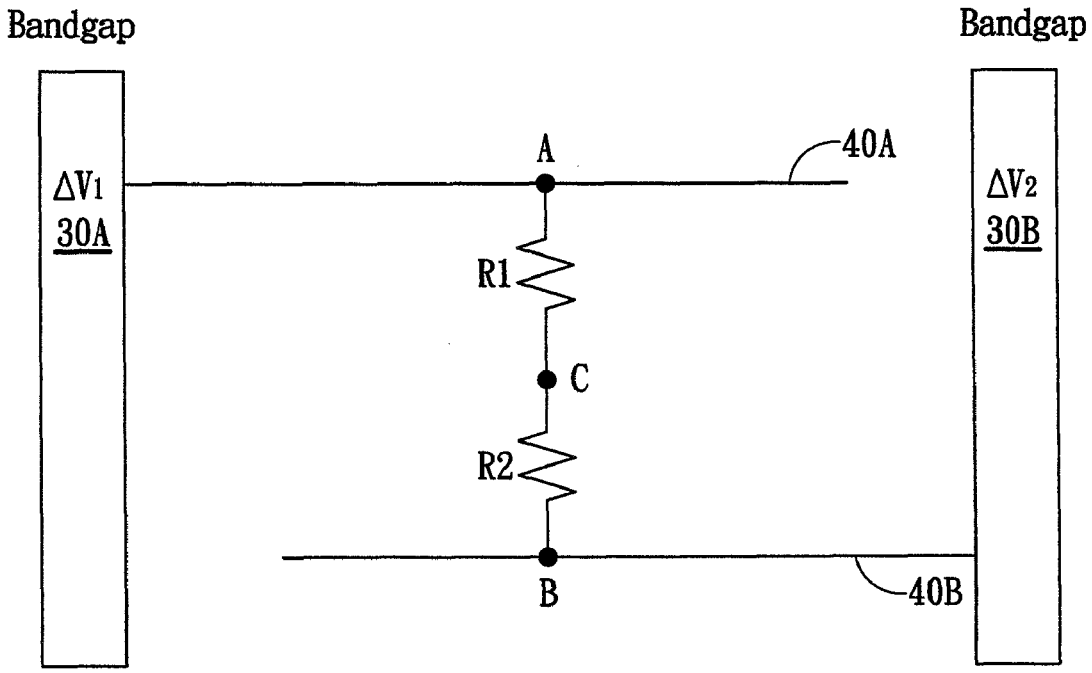
FIG. 4 shows an interconnection between the bandgap reference circuits according to the embodiment of the present invention.

FIG. 4 shows an interconnection between the two bandgap reference circuits 30A and 30B according to the embodiment of the present invention. The interconnected bandgap reference circuits 30A and 30B work as a whole to provide a reference voltage to other subsystem(s), such as the low-voltage subsystem 34 (FIG. 3). In the embodiment, a first conductive (e.g., metal) power line 40A electrically extends from an output reference voltage of the first bandgap reference circuit 30A, and a second conductive (e.g., metal) power line 40B electrically extends from an output reference voltage of the second bandgap reference circuit 30B. The first metal power line 40A and the second metal power line 40B are spaced apart by a distance, and are also laid out on the substrate 3 (FIG. 3). The ground line or lines are omitted in the figure for brevity.

In the embodiment, a conductive (e.g., metal) connecting line, represented by two resistors R1 and R2, is connected electrically between the first power line 40A (at node A) and the second power line 40B (at node B). The position of the node A or the node B is not limited to that in the exemplary figure. An interconnecting node C of the two resistors R1 and R2 is then used to provide a reference voltage, for example, to the low-voltage subsystem 34 (FIG. 3) or other subsystem in the entire system. As a result, an average reference voltage of the two reference voltages out of the bandgap reference system is generated by the resistors R1 and R2. It is appreciated that electronic components other than the resistors may replace the shown resistors, provided that the electronic components have the resistivities R1 and R2 respectively. It is further appreciated that the resistivity R1 and the resistivity R2 need not be the same.

According to the interconnection of FIG. 4, any mismatch between the first bandgap reference circuit 30A and the second bandgap reference circuit 30B due to manufacture parameter variances can be substantially reduced. Specifically, assume that the first bandgap reference circuit 30A generates a first deviated reference voltage $\Delta V_1$ due to the noise influence, and the second bandgap reference circuit 30B generates a second deviated reference voltage $\Delta V_2$ due to the noise influence. The first reference voltage $\Delta V_1$ and the second deviated reference voltage $\Delta V_2$ are then averaged by the serial-connected resistors R1 and R2, or a voltage divider. Accordingly, the resultant average deviated reference voltage $\frac{1}{2}(\Delta V_1+\Delta V_2)$ is substantially less than the deviated reference voltage $\Delta V_0$ generated by the single bandgap reference circuit 10 (FIG. 2), or $\frac{1}{2}(\Delta V_1+\Delta V_2)<\Delta V_0$.

According to the embodiment, the disclosed bandgap reference circuits and layout can minimize the amount of noise influence on the bandgap reference circuits 30A and 30B, and thus prevent the noise from being further distributed.

Figure 5:
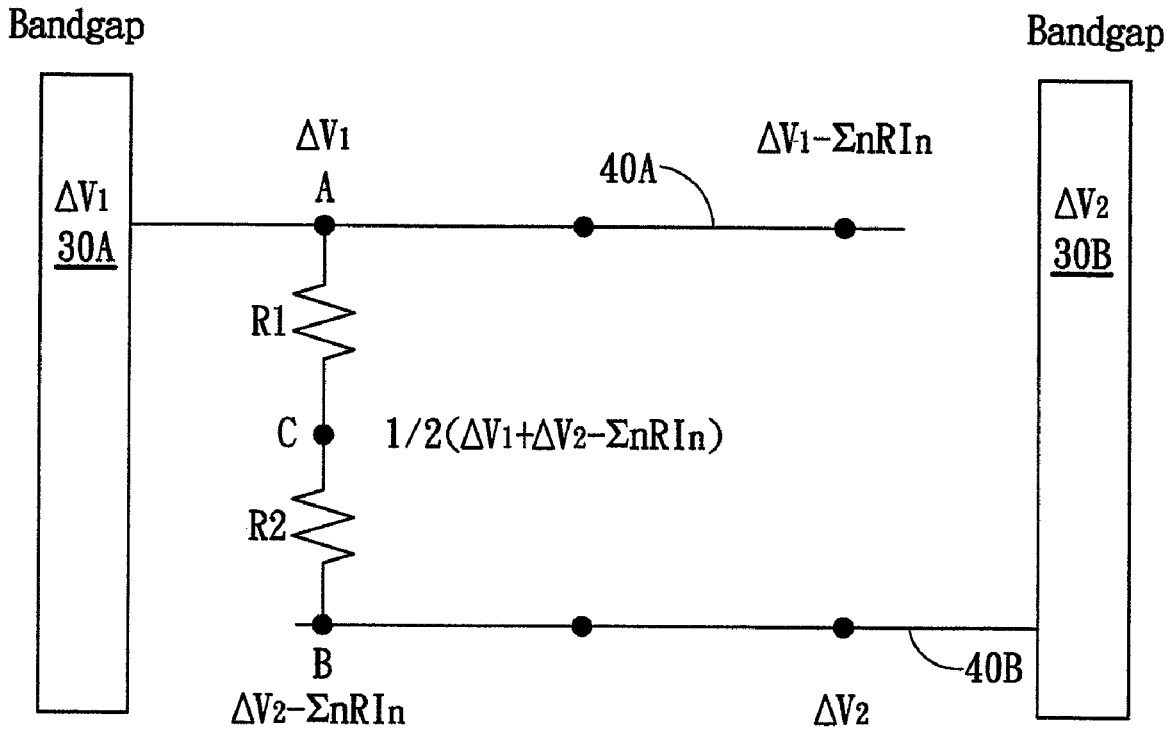
FIG. 5 illustrates the IR (current times resistance) voltage drop effect along a first power line, a second power line, and an interconnecting node.

In addition to the mismatch problem being improved by the serial-connected resistors R1 and R2 as discussed above, the IR (current times resistance) voltage drop effect along the first power line 40A and the second power line 40B, respectively, can be improved as well by the same serial-connected resistors R1 and R2. FIG. 5 illustrates the IR drop effect along the first power line 40A, the second power line 40B, and the interconnecting node C. Specifically, the first bandgap reference circuit 30A generates the first deviated reference voltage $\Delta V_1$, and the voltage at the first power line 40A may be expressed, in general, as $\Delta V_1-\Sigma nRI_n$, where n represents the n-th node away from the output reference node. Likewise, the second bandgap reference circuit 30B generates the first deviated reference voltage $\Delta V_2$, and the voltage at the second power line 40B may be expressed, in general, as $\Delta V_2-\Sigma nRI_n$, where n represents the n-th node away from the output reference node. The voltage at the interconnection node C thus has average deviated voltage $\frac{1}{2}(\Delta V_1+\Delta V_2-\Sigma nRI_n)$. Accordingly, the IR drop effect is substantially minimized by the serial-connected resistors R1 and R2, or the voltage divider.

Figure 6:
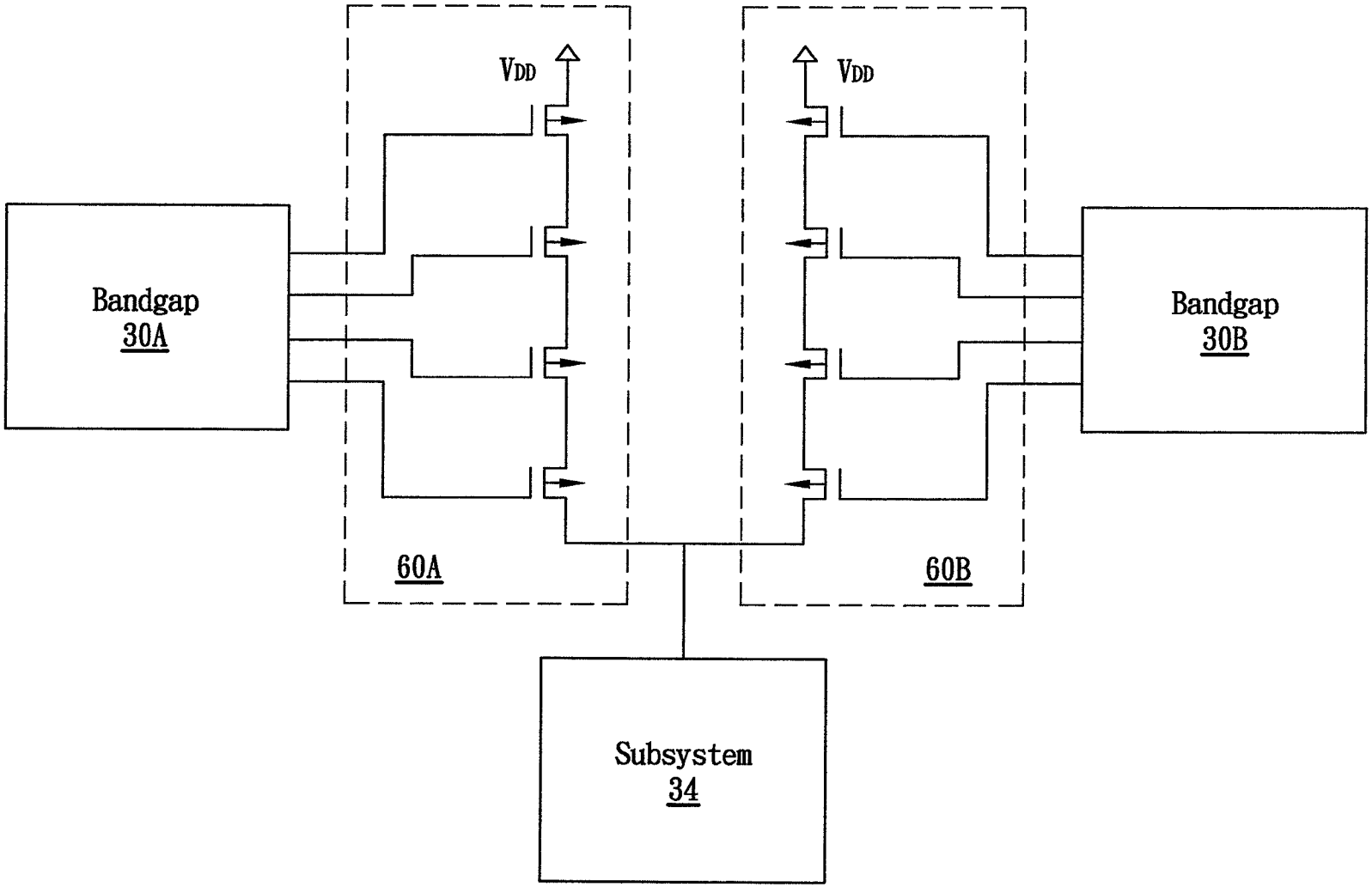
FIG. 6 shows an interconnection between the bandgap reference circuits according to another embodiment of the present invention.

FIG. 6 shows an interconnection between the two bandgap reference circuits 30A and 30B according to another embodiment of the present invention. The interconnected bandgap reference circuits 30A and 30B work as a whole to provide a reference current to one or more other subsystems, such as the low-voltage subsystem 34 (FIG. 3). In the embodiment, a first current source 60A, such as a mirror circuit, mirrors the output reference current of the first bandgap reference circuit 30A. The mirror circuit 60A, in the embodiment, includes four p-type metal-oxide-semiconductor (PMOS) transistors connected in series (i.e., serially), and the area of the PMOS transistors 60A is decreased by half (with respect to the output-stage transistors in the first bandgap reference circuit 30A) to obtain half of the output reference current. Likewise, a second current source 60B, such as a mirror circuit, mirrors the output reference current of the second bandgap reference circuit 30B. The mirror circuit 60B, in the embodiment, includes four PMOS transistors connected in series (i.e., serially), and the area of the PMOS transistors 60B is reduced in half (with respect to the output-stage transistors in the second bandgap reference circuit 30B) to obtain half of the output reference current. The (first) output current of the mirror circuit 60A and the (second) output current of another mirror circuit 60B are added as a whole to provide a reference current to another subsystem(s), such as the low-voltage subsystem 34 (FIG. 3).

According to the embodiment, the first current source 60A and the second current source 60B together can minimize the amount of noise influence and IR drop effect on the bandgap reference circuits 30A and 30B, and thus prevent the noise from being further distributed.

Although specific embodiments have been illustrated and described, it will be appreciated by those skilled in the art that various modifications may be made without departing from the scope of the present invention, which is intended to be limited solely by the appended claims.

What is claimed is:

1. A layout of a reference generating system, comprising:

at least one first voltage reference circuit and a second voltage reference circuit that are respectively laid out on either side of a substrate, the first voltage reference circuit being separated from the second voltage reference circuit in layout by an electronic circuit;

a first conductive power line electrically extending from a first output reference voltage of the first voltage reference circuit;

a second conductive power line electrically extending from a second output reference voltage of the second voltage reference circuit; and at least one conductive connecting line electrically coupled between the first conductive power line and the second conductive power line;

wherein a reference voltage node on the conductive connecting line is used to provide a reference voltage; and wherein the conductive connecting line includes a first electronic component and a second electronic component, with the reference voltage node being located at an interconnecting node of the first and the second electronic components.

2. The system of claim 1, wherein the first electronic component and the second electronic component have approximately the same resistivity.

* * * * *